US007863874B2

(12) United States Patent
Oelmaier

(10) Patent No.: US 7,863,874 B2
(45) Date of Patent: Jan. 4, 2011

(54) LINEAR VOLTAGE REGULATOR WITH A TRANSISTOR IN SERIES WITH THE FEEDBACK VOLTAGE DIVIDER

(75) Inventor: Reinhard Oelmaier, Laupheim (DE)

(73) Assignee: Atmel Automotive GmbH, Heilbronn (DE)

( * ) Notice: Subject to any disclaimer, the term of this patent is extended or adjusted under 35 U.S.C. 154(b) by 595 days.

(21) Appl. No.: 11/850,666

(22) Filed: Sep. 5, 2007

(65) Prior Publication Data

US 2008/0129261 A1 Jun. 5, 2008

Related U.S. Application Data

(60) Provisional application No. 60/842,042, filed on Sep. 5, 2006.

(51) Int. Cl.
*G05F 1/575* (2006.01)

(52) U.S. Cl. ..... 323/273; 323/303

(58) Field of Classification Search ..... 323/273–281, 323/303

See application file for complete search history.

(56) References Cited

U.S. PATENT DOCUMENTS 5,936,388 A * 8/1999 Casper ..... 323/273
6,140,805 A * 10/2000 Kaneko et al. ..... 323/280
6,218,819 B1 * 4/2001 Tiwari ..... 323/285
7,019,585 B1 * 3/2006 Wilson et al. ..... 327/541
2005/0189983 A1 * 9/2005 Sivero et al. ..... 327/536

* cited by examiner

*Primary Examiner*—Harry Behm
(74) *Attorney, Agent, or Firm*—Muncy, Geissler, Olds & Lowe, PLLC

(57) ABSTRACT

A linear voltage regulator is provided having a first transistor connected between a terminal for an input voltage and a terminal for an output voltage, a reference voltage source for producing a reference voltage, a first resistor, a second resistor, a second transistor, wherein the first resistor, the second resistor, and the second transistor are series-connected between the terminal for the output voltage and a reference voltage, and constitute a voltage divider, wherein a divided output voltage is present at a tap of the voltage divider, and also having a differential amplifier with an inverting input and a non-inverting input, wherein the inverting input is connected to the reference voltage source, the non-inverting input is connected to the tap of the voltage divider, and an output terminal of the differential amplifier is connected to a control terminal of the first transistor.

13 Claims, 2 Drawing Sheets

LINEAR VOLTAGE REGULATOR WITH A TRANSISTOR IN SERIES WITH THE FEEDBACK VOLTAGE DIVIDER

This nonprovisional application claims priority to U.S. Provisional Application No. 60/842,042, which was filed on Sep. 5, 2006, and is herein incorporated by reference.

BACKGROUND OF THE INVENTION

1. Field of the Invention

The present invention relates to a linear voltage regulator with a wide input voltage range.

2. Description of the Background Art

Linear voltage regulators produce a regulated output voltage from an input voltage. For voltage regulation, a differential or operational amplifier can be used, for example, whose non-inverting input is supplied with a constant reference voltage and whose inverting input is connected to a tap of a voltage divider, which is connected between a terminal for an output voltage and a reference voltage, typically ground. An output of the differential or operational amplifier is connected to what is called a pass transistor, which is connected between a terminal for the input voltage and the terminal for the output voltage. The pass transistor is driven as a function of the voltage difference at the differential or operational amplifier and changes its forward resistance accordingly, by which means the desired, regulated output voltage is established.

Proper function of such linear voltage regulators generally requires the input voltage to be greater than the desired output voltage by a defined minimum amount, since a voltage drop takes place at the pass transistor, with the input voltage and the output voltage differing by the amount of this voltage drop.

Regardless of this circumstance, in operating conditions in which the input voltage is too small, and in particular smaller than the desired output voltage, it is possible to produce an output voltage that is much too small, or even no output voltage at all. A cause of this can be, for example, that in spite of a decrease in the output voltage, the voltage difference at the differential amplifier does not increase such that the pass transistor is switched on sufficiently. This results in an excessive voltage drop at the pass transistor, and thus an output voltage that is too small.

SUMMARY OF THE INVENTION

It is therefore an object of the present invention to provide a linear voltage regulator with a wide input voltage range which still produces as high an output voltage as possible, in particular in the case of input voltage values that are smaller than the desired output voltage or than the output voltage in normal operation.

The inventive linear voltage regulator includes a first transistor, which can be connected between a terminal for an input voltage and a terminal for an output voltage. The first transistor may also be referred to as a pass transistor and is used for what is known as series regulation of the output voltage (as opposed to shunt regulation). In addition, a reference voltage source is provided for producing a predefinable reference voltage. A first resistor, a second resistor, and a second transistor are series-connected—although not necessarily in this order—between the terminal for the output voltage and a reference voltage, for example ground. The first resistor, the second resistor, and the second transistor form a voltage divider, wherein a divided voltage is present at a tap of the voltage divider. In addition a differential amplifier, for example an operational amplifier, with an inverting input and a non-inverting input is provided. The inverting input is connected to the reference voltage source, and the non-inverting input is connected to the tap of the voltage divider. An output terminal of the differential amplifier is connected to a control terminal of the first transistor. The second transistor serves as a voltage-dependent resistor within the voltage divider to produce the signal at the non-inverting input of the differential amplifier. When the input voltage decreases to values that are no longer sufficient to produce the desired or nominal output voltage, the forward resistance of the second transistor changes such that the voltage at the tap of the voltage divider decreases. This causes a voltage difference at the differential amplifier such that the latter turns on the first transistor as fully as possible, which merely causes a lower voltage drop at the first transistor. This has the result that the linear voltage regulator delivers an output voltage that is approximately the same as the input voltage when the input voltage is no longer sufficient to produce the desired output voltage.

In a further development, a control terminal of the second transistor can be connected to the reference voltage.

In a further development, a control terminal of the second transistor can be connected to the output voltage.

In a further development, the tap of the voltage divider can be a node connecting the second transistor to the second resistor.

In a further development, the tap of the voltage divider can be a node connecting the first resistor to the second resistor.

In a further development, the first transistor is a MOS transistor whose drain-source path can be connected between the terminal for the input voltage and the terminal for the output voltage and whose gate terminal is connected to the output terminal of the differential amplifier. The first transistor is preferably a normally-off PMOS transistor.

In a further development, the second transistor can be a normally-off PMOS transistor whose gate terminal is connected to the reference voltage. This has the result that the voltage at the tap of the voltage divider decreases disproportionately with decreasing output voltage, since the drain-source resistance of the second, normally-off transistor increases because its gate-source voltage decreases.

In a further development, the drain-source path of the second transistor can be connected between the first resistor and the second resistor.

In a further development, the drain-source path of the second transistor can be connected between the output voltage and the first resistor.

In a further development, the second transistor can be a normally-off NMOS transistor whose gate terminal is connected to the output voltage.

In a further development, the drain-source path of the second transistor can be connected between the first resistor and the second resistor.

In a further development, the reference voltage source can be designed such that it produces the reference voltage from the input voltage.

In a further development, the reference voltage source can be a band-gap reference.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
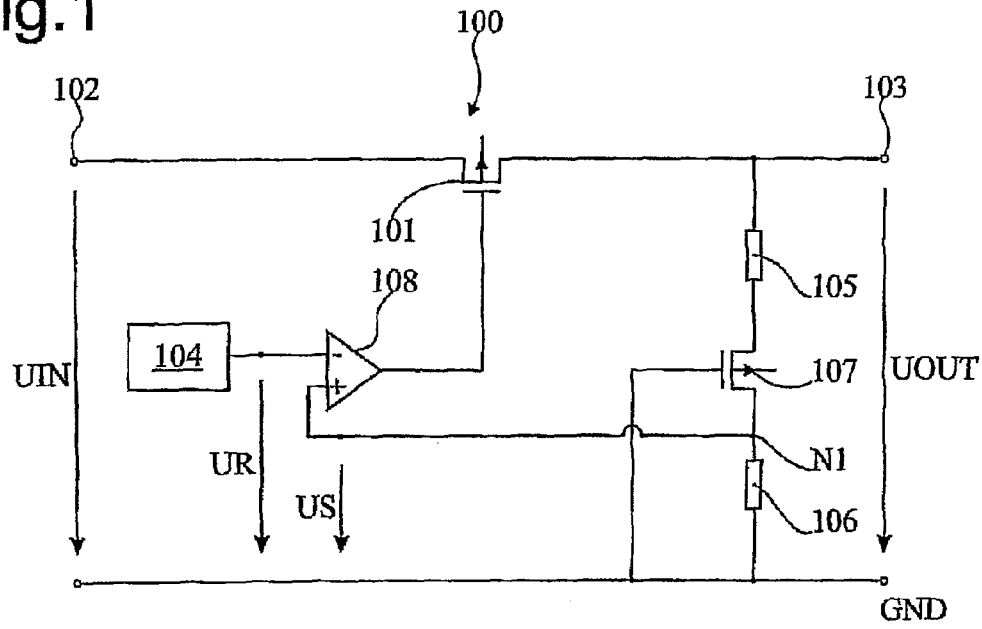
FIG. 1 is a schematic diagram of a first embodiment of a linear voltage regulator according to the invention.

FIG. 1 shows a schematic diagram of a linear voltage regulator 100 according to the invention. The linear voltage regulator 100 includes a first normally-off PMOS transistor 101, with this transistor or its drain-source path being connected between a terminal 102 for an input voltage UIN and a terminal 103 for an output voltage UOUT, a reference voltage source in the form of a band-gap reference 104 for producing a reference voltage UR, a first resistor 105, a second resistor 106, a second normally-off PMOS transistor 107, and a differential amplifier 108 having an inverting input and a non-inverting input.

The first resistor 105, the second transistor 107 or its drain-source path, and the second resistor 106 are connected in series in this sequence between the terminal 103 for an output voltage UOUT and a reference voltage in the form of the ground potential GND. The first resistor 105, the second transistor 107, and the second resistor 106 form a voltage divider, with a divided output voltage US being present at a tap N1 of the voltage divider. The tap N1 of the voltage divider is a node connecting the second transistor 107 and the second resistor 106.

The inverting input of the differential amplifier 108 is connected to the reference voltage source 104, and the non-inverting input of the differential amplifier 108 is connected to the tap N1 of the voltage divider. An output terminal of the differential amplifier 108 is connected to a control terminal, i.e. the gate terminal, of the first transistor 101. The band-gap reference 104 produces the reference voltage UR from the input voltage UIN.

A control terminal, i.e. the gate terminal, of the second transistor 107 is connected to the reference voltage GND.

Figure 2:
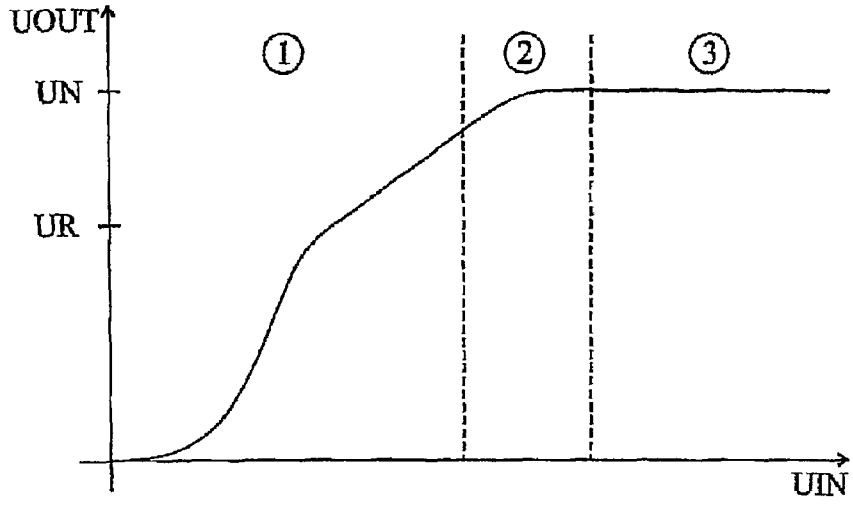
FIG. 2 is an output voltage curve as a function of an input voltage of the linear voltage regulator from FIG. 1.

FIG. 2 shows a curve of the output voltage UOUT as a function of the input voltage UIN of the linear voltage regulator 100 from FIG. 1.

In a region of the input voltage UIN labeled "3," the output voltage UOUT is equal to the desired output voltage UN, i.e. is independent of the value of the input voltage UIN. This is the normal operating mode of the voltage regulator 100. In this region, the second transistor 107 is turned essentially fully on. This has the result that a drain-source resistance of the second transistor 107 is much smaller than a resistance value of the first resistor 105. Consequently, the drain-source resistance of the second transistor 107 can thus be ignored. As a result, the voltage US at the tap N1 of the voltage divider is determined essentially by the values of the resistors 105 and 106 and the value of the output voltage UOUT.

When, for example, the input voltage UIN decreases in this input voltage range, this leads to a proportional voltage reduction at the non-inverting input of the differential amplifier 108, which causes its output voltage to decrease. The reduced output voltage of the differential amplifier 108 has the effect that the drain-source resistance of the first transistor 101 decreases, causing the voltage at its drain-source path to be reduced, which causes the output voltage UOUT to increase again, i.e., the decrease in the input voltage UIN is regulated out.

In a region of the input voltage UIN labeled "2," the output voltage UOUT can no longer be produced with the nominal level UN within the complete region "2." In the region "2" the drain-source resistance of the second transistor 107 increases sharply with decreasing input voltage UIN, causing the voltage US at the node N1 of the voltage divider to decrease disproportionately to the voltage UOUT or UIN. This leads to a disproportionate voltage reduction at the non-inverting input of the differential amplifier 108, which causes its output voltage to decrease sharply. The sharply reduced output voltage of the differential amplifier 108 has the effect that the drain-source resistance of the first transistor 101 decreases, causing the voltage drop at its drain-source path to be reduced. Thus, approximately the input voltage UIN is available as the output voltage UOUT.

In a region of the input voltage UIN labeled "1," the drain-source resistance of the second transistor 107 is substantially larger than the value of the resistor 105, which causes the voltage US at the node or tap N1 of the voltage divider to assume values in the range of the ground potential GND. Consequently, the differential amplifier 108 produces an output voltage that causes a turn-on of the transistor 101, thus minimizing the voltage drop at the transistor's drain-source resistance. Thus, approximately the input voltage UIN is available as the output voltage UOUT.

Figure 3:
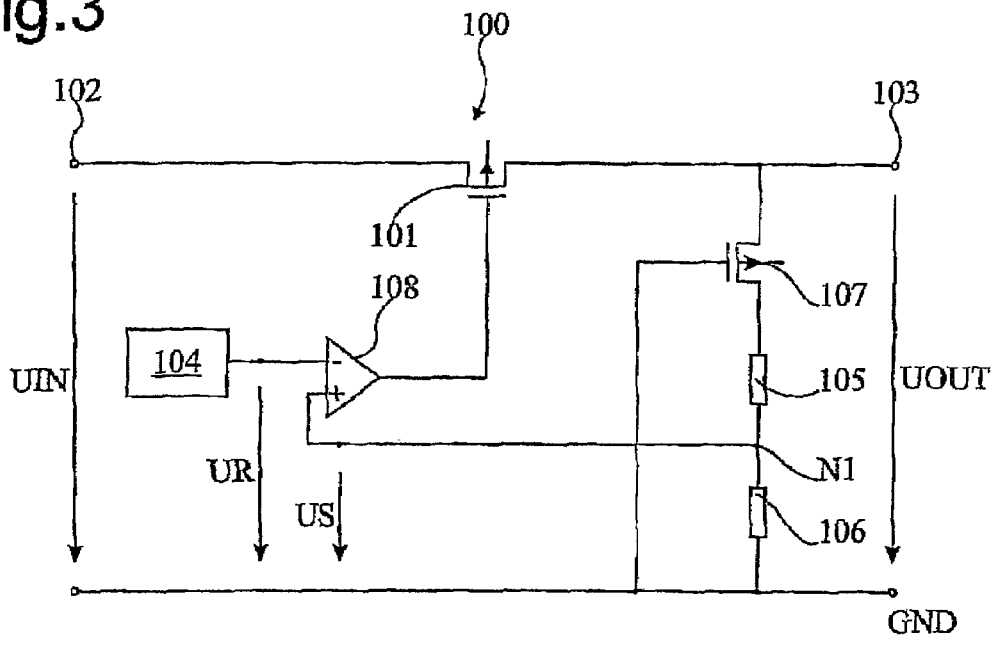
FIG. 3 is a schematic diagram of another embodiment of a linear voltage regulator according to the invention.

FIG. 3 shows a schematic diagram of another embodiment of an inventive linear voltage regulator. Elements that correspond to the elements shown in FIG. 1 are labeled with identical reference characters. In the embodiment shown in FIG. 3, the placement of the first resistor 105 and second transistor 107 is swapped, i.e. the drain-source path of the second transistor 107 is connected between the output voltage UOUT and the first resistor 105, and the tap N1 of the voltage divider is a node connecting the first resistor 105 to the second resistor 106. Otherwise, the embodiment shown in FIG. 3 functions in a manner corresponding to the embodiment shown in FIG. 1.

Figure 4:
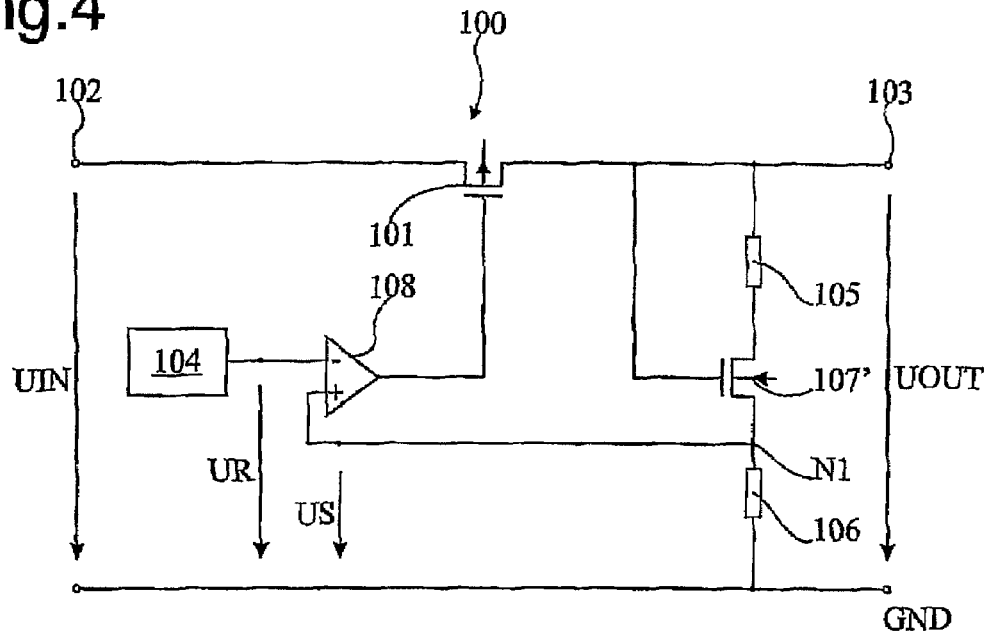
FIG. 4 is a schematic diagram of another embodiment of a linear voltage regulator according to the invention.

FIG. 4 shows a schematic diagram of another embodiment of an inventive linear voltage regulator. Elements that correspond to the elements shown in FIG. 1 are labeled with identical reference characters. In the embodiment shown in FIG. 4, the PMOS transistor 107 is replaced by an NMOS transistor 107' whose gate terminal is connected to the output voltage UOUT. With an adequate input voltage UIN, i.e. in normal operation, the second transistor 107' is essentially fully switched on. This has the effect that a drain-source resistance of the second transistor 107' is a great deal smaller than the resistance value of the first transistor 105. The drain-source resistance of the second transistor 107' can thus be ignored. The voltage US at the tap N1 of the voltage divider is consequently determined essentially by the values of the resistors 105 and 106 and the value of the output voltage UOUT.

As the input voltage UIN decreases, the gate-source voltage of the NMOS transistor 107' is no longer sufficient to fully turn it on, i.e., its drain-source resistance increases significantly. As in the embodiments shown in FIG. 1 or FIG. 3, this has the result that the voltage at the non-inverting input of the differential amplifier 108 decreases disproportionately to the input voltage UIN, which causes the pass transistor 101 to be turned on as fully as possible, i.e. the voltage drop at the pass transistor 101 is minimized.

The basis of the embodiments shown is that the voltage divider at the output of the linear voltage regulator 100, which in conventional voltage regulators includes only the resistors 105 and 106, is augmented by a voltage-dependent resistor in the form of the PMOS transistor 107 or 107'. As a result of appropriately dimensioning the resistive divider having the resistors 105 and 106 and transistor 107 or 107', the voltage regulator 100 supplies as output voltage UOUT approximately the input voltage UIN, when the input voltage UIN is no longer sufficient to produce the desired output voltage UN.

The characteristic curve shown in FIG. 2 shows that the voltage regulator 100 supplies an output voltage UOUT that corresponds approximately to the input voltage UIN for values of the input voltage UIN that fall below a limit value which is not sufficient for producing the desired output voltage UN. In this way, it is possible to cover an additional input voltage range. This is especially useful for battery-backed applications, for example mobile battery-operated global positioning systems.

Of course, customary circuit design measures, such as replacing PMOS transistors by NMOS transistors and the like, are included within the scope of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A linear voltage regulator for regulating an output voltage, comprising:

a first transistor, which is connected between a terminal for an input voltage and a terminal for the output voltage;

a reference voltage source for producing a first reference voltage;

a first resistor;

a second resistor;

a second transistor, wherein the first resistor, the second transistor, and the second resistor are series-connected between the terminal for the output voltage and a second reference voltage and constitute a voltage divider, and wherein a divided output voltage is present at a tap of the voltage divider; and a differential amplifier having an inverting input and a non-inverting input, wherein the inverting input is connected to the reference voltage source, the non-inverting input is connected to the tap of the voltage divider, and an output terminal of the differential amplifier is connected to a control terminal of the first transistor, and wherein, in a normal operating mode the output voltage is independent of the value of the input voltage and the second transistor is turned substantially fully on, and wherein, not in the normal operating mode, a drain-source resistance of the second transistor increases sharply with decreasing input voltage causing the divided output voltage at a tap of the voltage divider to decrease disproportionately to the output voltage.

2. The linear voltage regulator according to claim 1, wherein a control terminal of the second transistor is connected to the second reference voltage.

3. The linear voltage regulator according to claim 1, wherein a control terminal of the second transistor is connected to the output voltage.

4. The linear voltage regulator according to claim 1, wherein the tap of the voltage divider is a node connecting the second transistor to the second resistor.

5. The linear voltage regulator according to claim 1, wherein the tap of the voltage divider is a node connecting the first resistor to the second resistor.

6. The linear voltage regulator according to claim 1, wherein the first transistor is a MOS transistor whose drain-source path is connected between a terminal for the input voltage and a terminal for the output voltage and whose gate terminal is connected to an output terminal of the differential amplifier.

7. The linear voltage regulator according to claim 1, wherein the first transistor is a normally-off PMOS transistor.

8. The linear voltage regulator according to claim 1, wherein the second transistor is a normally-off PMOS transistor whose gate terminal is connected to the reference voltage.

9. The linear voltage regulator according to claim 1, wherein a drain-source path of the second transistor is connected between the first resistor and the second resistor.

10. The linear voltage regulator according to claim 1, wherein a drain-source path of the second transistor is connected between the output voltage and the first resistor.

11. The linear voltage regulator according to claim 1, wherein the second transistor is a normally-off NMOS transistor whose gate terminal is connected to the output voltage.

12. The linear voltage regulator according to claim 1, wherein the reference voltage source is designed such that it produces the reference voltage from the input voltage.

13. The linear voltage regulator according to claim 1, wherein the reference voltage source is a band-gap reference.

* * * * *